US011427418B2

(12) United States Patent
Oshida et al.

(10) Patent No.: US 11,427,418 B2
(45) Date of Patent: Aug. 30, 2022

(54) SHEET PROCESSING APPARATUS

(71) Applicant: TOSHIBA TEC KABUSHIKI KAISHA, Tokyo (JP)

(72) Inventors: Katsuya Oshida, Mishima Shizuoka (JP); Mikio Yamamoto, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 71 days.

(21) Appl. No.: 17/122,821

(22) Filed: Dec. 15, 2020

(65) Prior Publication Data

US 2021/0253380 A1 Aug. 19, 2021

(30) Foreign Application Priority Data

Feb. 14, 2020 (JP) ..... JP2020-023668

(51) Int. Cl.
*B65H 1/26* (2006.01)

(52) U.S. Cl.
CPC ..... *B65H 1/266* (2013.01); *B65H 2402/542* (2013.01); *B65H 2405/121* (2013.01); *B65H 2801/06* (2013.01)

(58) Field of Classification Search
CPC .... B65H 1/26; B65H 1/266; B65H 2402/542; B65H 2405/121; B65H 2405/31; B65H 2405/32; B65H 2801/06
See application file for complete search history.

(56) References Cited

U.S. PATENT DOCUMENTS 8,408,535 B2 * 4/2013 Miki ..... B65H 1/266 271/145
2006/0180996 A1 * 8/2006 Iwase ..... B65H 1/266 271/162
2016/0334745 A1 * 11/2016 Kwon ..... G03G 15/6502

FOREIGN PATENT DOCUMENTS

JP 2008254841 A 10/2008
JP 2011020789 A 2/2011
JP 2013256355 A 12/2013

OTHER PUBLICATIONS

Extended European Search Report dated Jun. 29, 2021, mailed in counterpart European Application No. 21153199.1, 8 pages.

* cited by examiner

*Primary Examiner* — Prasad V Gokhale
(74) *Attorney, Agent, or Firm* — Kim & Stewart LLP

(57) ABSTRACT

A sheet processing apparatus has a main body with an insertion slot for a sheet cassette. The sheet cassette has a moveable pin member. A housing in the main body includes a lever partially rotatable about a first axis. The lever has a pin engagement portion at an end of the lever that rotates about a second axis and has an engagement groove into which the pin member can be inserted from a first pin engagement position and a second pin engagement position when the lever has rotated about the first axis. An elastic member applies a force to the lever to rotate the lever toward the insertion direction of the cassette. The housing includes a chassis having a guide groove extending along the insertion direction. The guide groove includes an inclining portion that is inclined with respect to the insertion direction.

20 Claims, 9 Drawing Sheets

SHEET PROCESSING APPARATUS

CROSS-REFERENCE TO RELATED APPLICATIONS

This application is based upon and claims the benefit of priority from Japanese Patent Application No. 2020-023668, filed on Feb. 14, 2020, the entire contents of which are incorporated herein by reference.

FIELD

Embodiments described herein relate generally to a sheet processing apparatus, such as an image forming apparatus or an image processing apparatus.

BACKGROUND

Conventionally, in an image forming apparatus or an image processing apparatus that either prints an image on a sheet or erases an image from a sheet, a sheet cassette that can be inserted into and removed from the main body of the apparatus is used to store sheets that have not yet been processed (e.g., printed or decolored). In order to reduce the burden on a user when inserting sheet cassettes into the main body of the apparatus, structure has been proposed by which a helping pull-in force is applied to the sheet cassette when inserted.

In an image forming apparatus of the related art, the apparatus includes a main body, a sheet cassette, an engagement portion, and a toggle mechanism. The engagement portion is provided in the sheet cassette. The toggle mechanism is provided in the main body.

In this type of image forming apparatus, the engagement portion and the toggle mechanism engage with each other when the sheet cassette is inserted into the main body, and then a force from the toggle mechanism is applied to the engagement portion to aid with cassette insertion.

However, in the image forming apparatus of the related art, the possible case is not well handled in which, after the sheet cassette has been inserted into and attached to the main body, the engagement between the engagement portion and the toggle mechanism is improperly released for some reason. In such a case, the sheet cassette can be pulled out from the main body without operating the toggle mechanism in the intended manner. If the engagement between the sheet cassette and the pull-in aiding toggle mechanism of the sheet cassette cannot be properly engaged due to improper previous release of the sheet cassette from the pull-in mechanism, the user may not be able to easily reengage the sheet cassette with the pull-in mechanism.

DETAILED DESCRIPTION

One or more embodiments provide a sheet processing apparatus that allows a user to easily reengage a sheet cassette even when the sheet cassette and a sheet cassette pull-in mechanism or the like were not properly disengaged from each other after a previous insertion of the sheet cassette.

According to one embodiment, a sheet processing apparatus includes a main body with an insertion slot. A sheet cassette is configured to be inserted into the main body via the insertion slot and removed from the main body via the insertion slot. The sheet cassette includes a pin member extending in a first direction orthogonal to an insertion direction of the sheet cassette. The pin member is connected to the sheet cassette so as to be moveable in a second direction orthogonal to the first direction and the insertion direction. A housing is in the main body and includes a lever partially rotatable about a first axis proximate to a first end of the lever. The first axis is parallel to first direction. The lever has a pin engagement portion at a tip portion at a second end of the lever opposite the first end. The pin engagement portion is rotatable about a second axis parallel to the first direction. The pin engagement portion has an engagement groove into which the pin member can be inserted from a first pin engagement position and a second pin engagement position when the lever has rotated about the first axis. An elastic member is configured to apply a force to the lever to rotate the lever toward the insertion direction. The elastic member is connected to the lever at a position between the first axis and the pin engagement portion. The housing includes a chassis having a guide groove formed therein. The guide groove extends along the insertion direction and controls the position of the pin member in the second direction. The guide groove includes an inclining portion that is inclined with respect to the insertion direction and is farther along the insertion direction than an intake portion of the guide groove for receiving the pin member into the guide groove.

Hereinafter, a sheet processing apparatus according to an example embodiment will be described with reference to the drawings.

Figure 1:
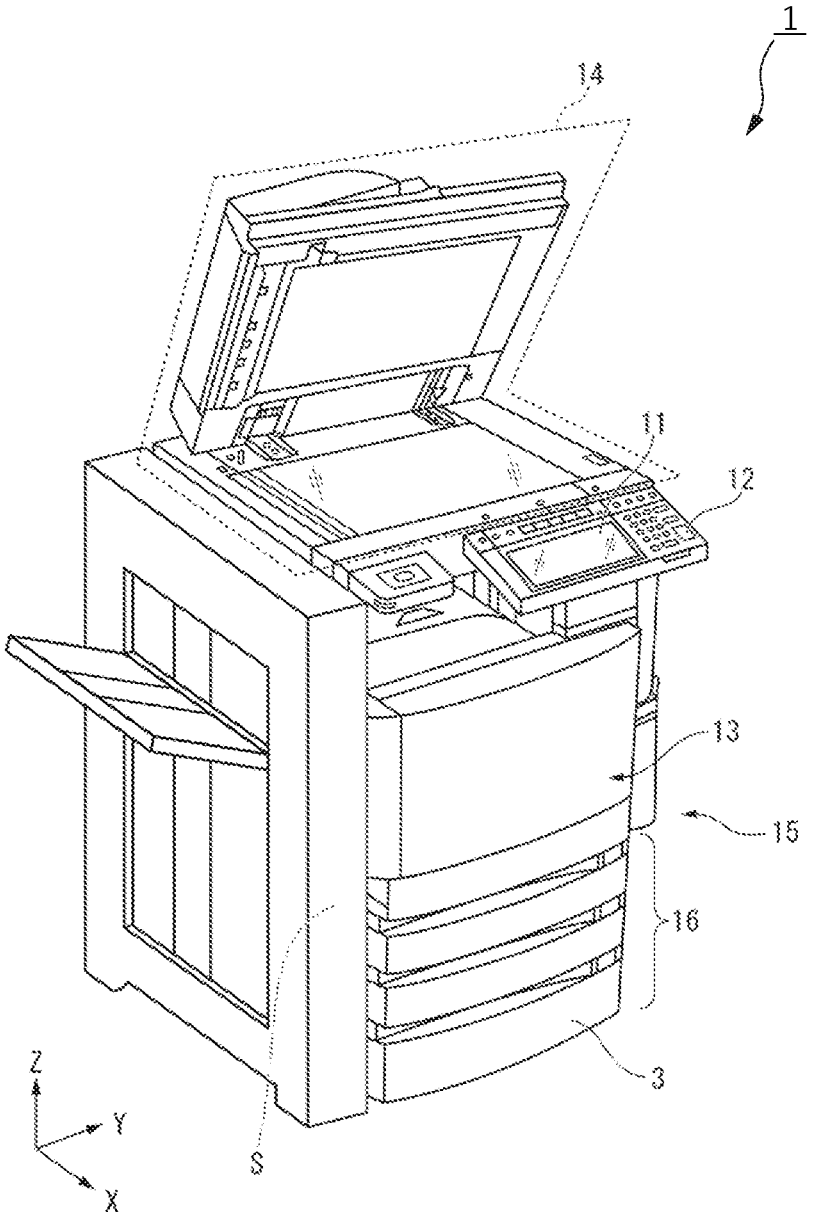
FIG. 1 is a perspective view of a sheet processing apparatus according to an embodiment.

FIG. 1 is a perspective view of a sheet processing apparatus 1 according to an embodiment. The sheet processing apparatus 1 is, for example, an image forming apparatus, such as a multi-function peripheral (MFP) device, a printer, a copying machine, or the like.

As shown in FIG. 1, the sheet processing apparatus 1 includes a display 11, a control panel unit 12, an image forming unit 13, an image reading unit 14, a main body 15, and a sheet accommodation unit 16.

The display 11 and the control panel unit 12 are used by a user to check operation parameters and input user commands for operating the image sheet processing apparatus 1. The image forming unit 13 prints an image on a paper sheet or the like. The image reading unit 14 scans documents and converts characters and images printed thereon into electronic data.

Figure 2:
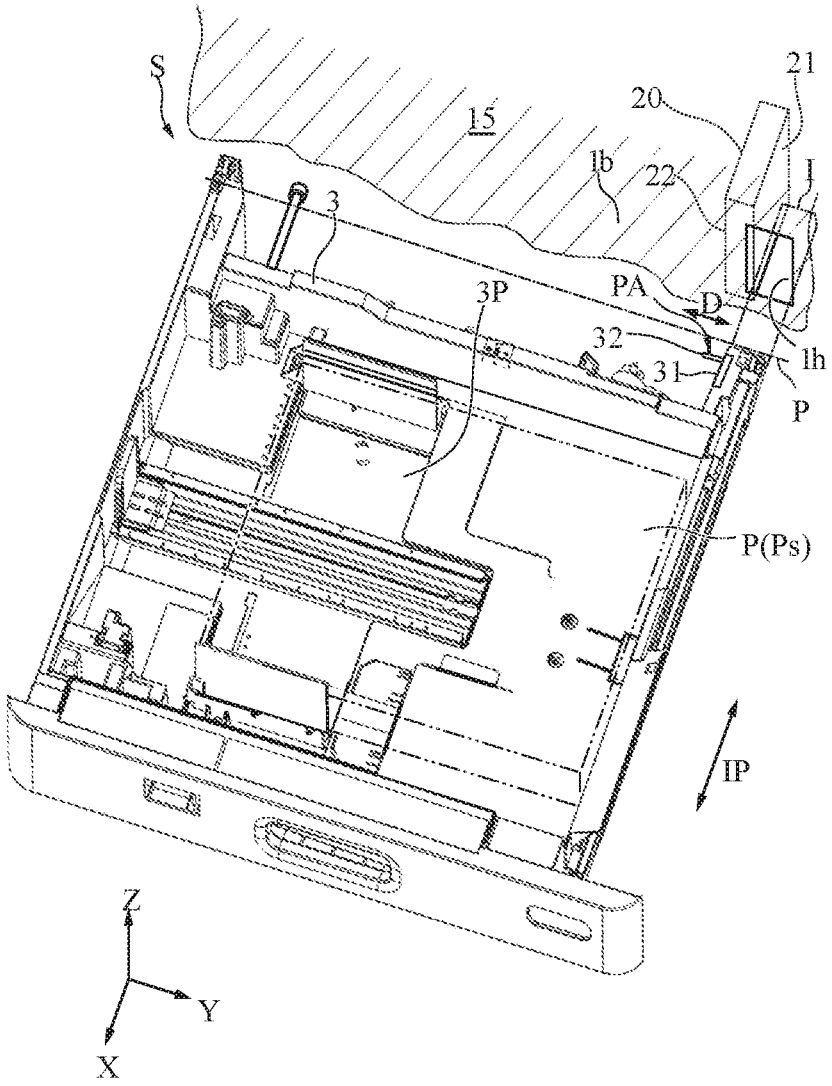
FIG. 2 is a perspective view illustrating a space in a lower portion of a main body of a sheet processing apparatus according to an embodiment.

The main body 15 is a housing that incorporates the display 11, the control panel unit 12, the image forming unit 13, the image reading unit 14, and the sheet accommodation unit 16. The main body 15 incorporates the sheet accommodation unit 16 in a lower space S. The lower space S may be referred to as a stand or a printer stand in some instances. The sheet accommodation unit 16 has a sheet cassette 3. FIG. 2 is a perspective view illustrating aspects of the lower space S in the lower portion of the main body 15. In FIG. 2, two of the three depicted sheet cassettes 3 depicted in FIG. 1 for the sheet accommodation unit 16 are omitted and just one sheet cassette 3 is depicted.

As shown in FIG. 2, the main body 15 has a surface 1*b* and a sheet cassette lead-in mechanism 20. The surface 1*b* is a surface facing the front side of the sheet processing apparatus 1. The surface 1*b* also forms an inner surface of the main body 15 that faces into the lower space S. An introduction hole 1*h* is formed in the surface 1*b*. The introduction hole 1*h* penetrates the surface 1*b* and has a substantially rectangular shape in a front view. When the sheet cassette 3 is inserted in the main body 15, a part of the sheet cassette 3 passes through the introduction hole 1*h*.

The sheet cassette lead-in mechanism 20 applies a force to the sheet cassette 3 to promote insertion ("lead-in") of the sheet cassette 3 into the main body 15. The sheet cassette lead-in mechanism 20 is connected to the surface 1*b* inside the main body 15.

Figure 3:
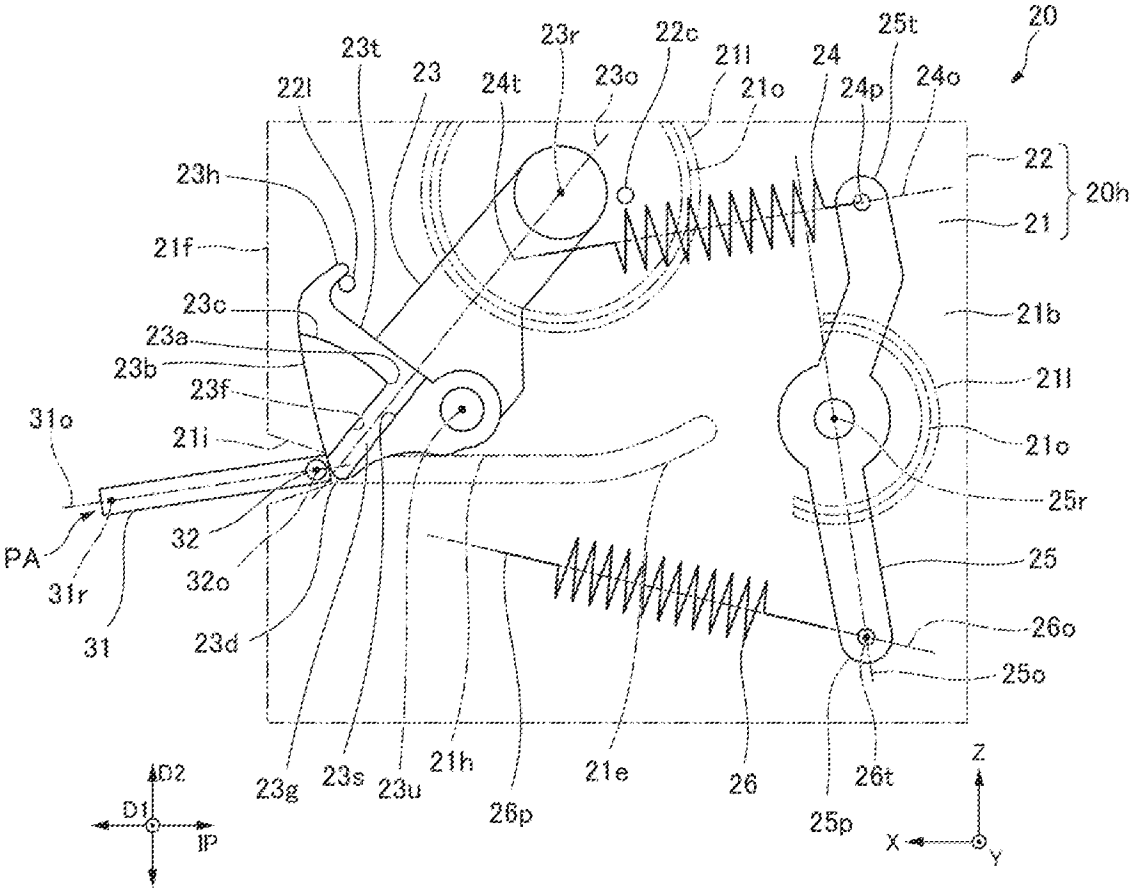
FIG. 3 is a side view a sheet cassette mechanism according to an embodiment.

FIG. 3 is a side view of the sheet cassette lead-in mechanism 20. As shown in FIG. 3, the sheet cassette lead-in mechanism 20 has a housing 20*h*, a lever 23, an elastic member 24, an auxiliary lever 25, and an auxiliary elastic member 26.

The housing 20*h* incorporates the lever 23, the elastic member 24, the auxiliary lever 25, and the auxiliary elastic member 26. The housing 20*h* comprises a chassis 21 and a cover 22. The chassis 21 has a substantially plate shape. The chassis 21 is connected to the surface 1*b* so that a plate surface 21*b* is orthogonal to the left-right direction of the main body 15. As shown in FIG. 2, the plate surface 21*b* partially overlaps the introduction hole 1*h* in a front view.

As shown in FIG. 3, an introduction groove 21*i* is formed at the center in the up-down direction at a front end portion 21*f* of the plate surface 21*b* of the chassis 21. The width of the introduction groove 21*i* decreases toward the rear side of the main housing 15.

A guide groove 21*h* extending from the introduction groove 21*i* toward the back side of the main housing 15 is formed on the plate surface 21*b* of the chassis 21. The guide groove 21*h* has an end portion 21*e* curved upward.

On the plate surface 21*b* of the chassis 21, an arc-shaped sliding rib 21*l* having an arc shape in a side view is formed on the left side of the plate surface 21*b*. The sliding rib 21*l* is formed on an upper side of the plate surface 21*b*. In the sliding rib 21*l*, an oil groove 21*o* having an arc shape is formed at a left end portion of the sliding rib 21*l*.

The cover 22 has a substantially box-like shape having an opening. The cover 22 is fitted on the edge of the plate surface 21*b* with an edge of the opening of the cover 22, and is fitted to the plate surface 21*b*. The cover 22 is joined to the plate surface 21*b* from the left side. The cover 22 has a locking portion 22*l* on the upper side on the front side. The locking portion 22*l* has an elliptical columnar shape in which the shaft extends in the left-right direction. The cover 22 has an abutting portion 22*c* on the upper side on the back side. The abutting portion 22*c* has a columnar shape in which the shaft extends in the left-right direction.

The lever 23 is formed in an elongated shape having an axis dimension 23*o*. The lever 23 is, for example, formed as a substantially plate shaped piece. The lever 23 is connected to the housing 20*h* so that a proximal end of the lever 23 is rotatable about a main rotation shaft 23*r* along the left-right direction. The main rotation shaft 23*r* is sandwiched between the chassis 21 and the cover 22. The lever 23 is connected to the chassis 21 and the cover 22 so that an axial dimension 23*o* extends along a plane including the depth direction and the up and down direction. The main rotation shaft 23*r* is disposed substantially in the center of the chassis 21 and the cover 22 in the depth direction. The main rotation shaft 23*r* is disposed on the upper side in the up-down direction of the chassis 21 and the cover 22. The main rotation shaft 23*r* is disposed so as to pass through the center of the region formed by sliding rib 21*l*. The lever 23 has a rotation angle to the front side greater than the rotation angle to the far side.

The lever 23 has a pin engagement portion 23*t* at a tip portion thereof. The pin engagement portion 23*t* is provided on the lever 23 so as to be rotatable about a sub-rotation shaft 23*u* along the left-right direction. The pin engagement portion 23*t* has an engagement groove 23*g* on the side nearer to the side of the sub-rotation shaft 23*u*. The engagement groove 23*g* has a first side wall 23*f* and a second side wall 23*s*. The second side wall 23*s* is disposed on a deeper side than the first side wall 23*f*. The engagement groove 23*g* extends to an edge 23*d* below the pin engagement portion 23*t*, and the tip of the engagement groove 23*g* is formed in the edge 23*d* of the pin engagement portion 23*t*.

The pin engagement portion 23*t* has a contact surface 23*c*. The contact surface 23*c* is formed along the left-right direction. The contact surface 23*c* is formed continuously with the first side wall 23*f*. The contact surface 23*c* extends to the side opposite to the second side wall 23*s* and is formed up to the edge 23*b* on the front side of the pin engagement portion 23*t*. A leading end of the contact surface 23*c* is formed on the edge 23*b* of the pin engagement portion 23*t*. The contact surface 23*c* is curved in a convex shape in a direction away from the first side wall 23*f*.

The pin engagement portion 23*t* has a hook 23*h*. The hook 23*h* is provided above the contact surface 23*c* on the front side of the first side wall 23*f*.

The elastic member 24 has an axial dimension 24*o*, and is, for example, a coil spring. A tip portion 24*t* along the axial dimension 24*o* of the elastic member 24 is connected between the main rotation shaft 23*r* of the lever 23 and the pin engagement portion 23*t*.

The auxiliary lever 25 has axial dimension 25*o* and formed in, for example, a substantially plate shape. The auxiliary lever 25 is connected to the chassis 21 and the cover 22 so as to be rotatable about a rotation shaft 25*r* extending along the left-right direction. The rotation shaft 25*r* is sandwiched between the chassis 21 and the cover 22. The auxiliary lever 25 is connected to the chassis 21 and the cover 22 so that the axial dimension 25*o* extends along a plane including the depth direction and the up and down direction. The auxiliary lever 25 is disposed on a deeper side than the lever 23. The rotation shaft 25*r* is disposed on the deep side in the depth direction of the chassis 21 and the cover 22. The rotation shaft 25*r* is disposed substantially in the center of the chassis 21 and the cover 22 in the up-down direction.

The auxiliary lever 25 is connected to a proximal end 24*p* in the axial dimension 25*o* direction, and a proximal end opposite to the tip portion 24*t* in the direction of the axial dimension 24*o* of the elastic member 24 is connected to a tip 25*t* in the axial direction of the axial direction. The tip 25*t* is disposed above the rotation shaft 25*r*.

The auxiliary elastic member 26 has an axial dimension 26*o*, and is, for example, a coil spring. In the auxiliary elastic member 26, a tip 26*t* in the axial dimension 26*o* direction is connected to a proximal end 25*p* that is opposite to the tip 25*t* in the direction of the axial dimension 25*o* of the auxiliary lever 25. In the auxiliary elastic member 26, a proximal end 26*p* opposite to the tip 26*t* in the direction of the shaft 26*o* is connected to the front side of the cover 22.

When the sheet cassette lead-in mechanism 20 is not in operation, the hook 23*h* of the lever 23 is locked to the locking portion 22*l* of the cover 22. When the sheet cassette lead-in mechanism 20 is not in operation, the elastic member 24 and the auxiliary elastic member 26 are in a tensioned state. When the sheet cassette lead-in mechanism 20 is not in operation, the forces and the moments acting on the lever 23, the elastic member 24, the auxiliary lever 25, and the auxiliary elastic member 26 are balanced. At this time, the engagement groove 23*g* and the guide groove 21*h* are arranged so that the tip of the engagement groove 23*g* overlaps the guide groove 21*h* in the side view.

The sheet cassette 3 can be inserted into and removed from the main body 15. The sheet cassette 3 has an insertion/extraction direction IP along the depth direction (the Y-axis direction) of the sheet processing apparatus 1. The sheet cassette 3 has an extraction position P when it is pulled out from the main body 15, and an insertion position I when it is inserted into the main body 15. As shown in FIG. 2, the sheet cassette 3 is formed in a box shape that opens upward with a sheet stack surface 3P as a bottom surface. A sheet cassette 3 the sheets P can be stacked to a stacking height equal to or lower than the maximum stacking height.

The sheet cassette 3 has an insertion end PA. The insertion end PA is disposed at an end portion on the back side of the sheet cassette 3. FIG. 3 shows a side view of the insertion end PA. As shown in FIG. 3, the insertion end PA has a link member 31 and a pin member 32.

The link member 31 has an axial dimension 31*o*, and is formed, for example, in a plate shape. The link member 31 is connected to the sheet cassette 20 so as to be rotatable about a rotation shaft 31*r* along the left-right direction. The link member 31 is connected to the sheet cassette 3 so that the axial dimension 31*o* extends along a plane including the insertion/extraction direction IP and the up-down direction.

The pin member 32 has an axial dimension 32*o*, and is formed, for example, in a columnar shape. The pin member 32 is connected to the tip of the link member 31 so that a first direction D1, which is the direction of the axial dimension 32*o*, is orthogonal to the insertion/extraction direction IP. In the present embodiment, the first direction D1 extends in the left-right direction (the Y-axis direction). The pin member 32 moves in the insertion/extraction direction IP and a second direction D2 orthogonal to the first direction D1 with respect to the sheet cassette 3 in accordance with the rotation of the link member 31. In the present embodiment, the second direction D2 extends in the up-down direction (Z-axis direction). The pin member 32 is formed such that the distance between the first side wall 23*f* and the second side wall 23*s* is equal to or less than 1.2 times the diameter of the cross-section orthogonal to the axial dimension 32*o* of the pin member 32.

Next, the operation of the sheet cassette lead-in mechanism 20 when the sheet cassette 3 is inserted into and removed from the sheet processing apparatus 1 will be described.

When the sheet cassette 3 is inserted into the sheet processing apparatus 1, the pin member 32 contacts the edge of the introduction groove 21*i* of the sheet cassette lead-in mechanism 20, and the pin member 32 is introduced into the guide groove 21*h* and runs through the guide groove 21*h*. When the pin member 32 is inserted into the guide groove 21*h*, the pin member 32 comes into contact with the pin engagement portion 23*t*. FIG. 3 illustrates a state immediately before the sheet cassette 3 is inserted into the sheet processing apparatus 1 and the pin member 32 and the lever 23 are brought into contact with each other.

When the sheet cassette 3 is further inserted beyond the state illustrated in FIG. 3, the lever 23 is pushed by the pin member 32 toward the back side on the second side wall 23*s*, and the engagement between the locking portion 22*l* of the cover 22 and the hook 23*h* of the lever 23 is released.

When the engagement between the locking portion 22*l* and the hook 23*h* is released, a force is applied from the elastic member 24 to the lever 23 that rotates the lever 23 toward the insertion direction side. When the lever 23 rotates toward the insertion direction side, the first side wall 23*f* of the pin engagement portion 23*t* abuts against the pin member 32, and a force in the insertion direction is applied from the first side wall 23*f* to the pin member 32.

Figure 4:
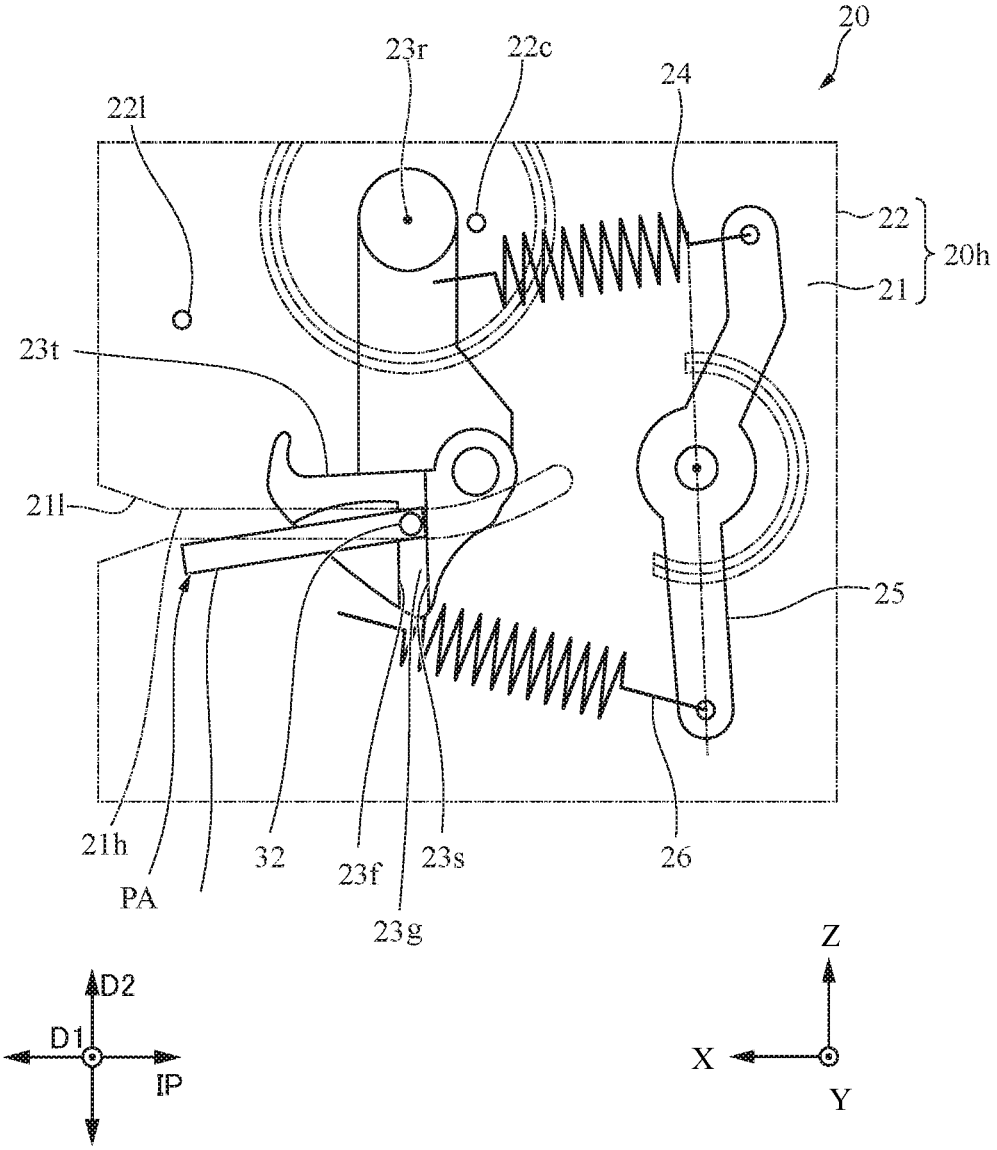
FIG. 4 is a side view of a sheet cassette mechanism according to an embodiment.

FIG. 4 is a view illustrating a state in which the sheet cassette 3 has been further inserted into the main body 15 beyond the state illustrated in FIG. 3. As shown in FIG. 4, the pin member 32 moves along the guide groove 21*h*.

Figure 5:
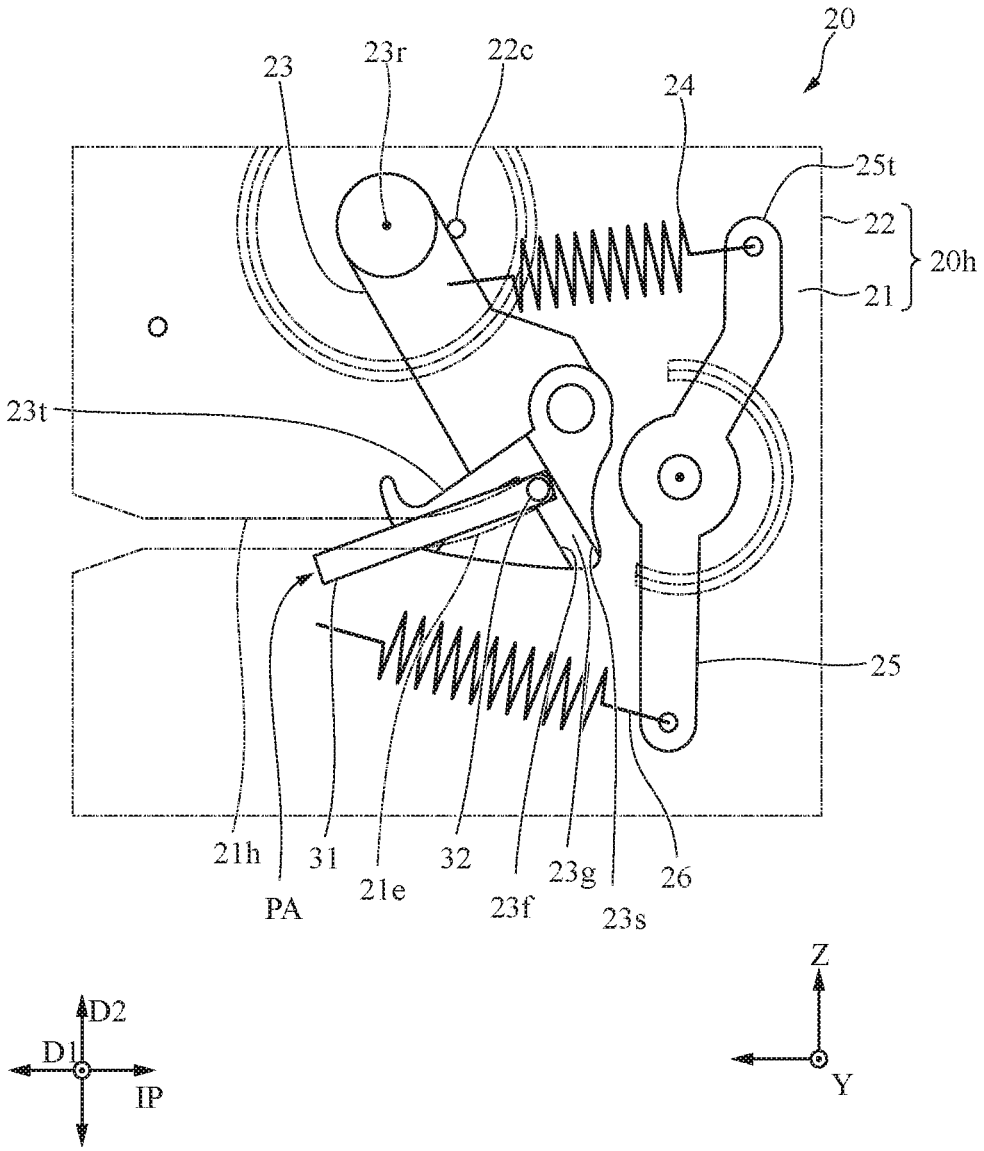
FIG. 5 is a side view of a sheet cassette mechanism according to an embodiment.

FIG. 5 is a diagram illustrating a state in which the sheet cassette 3 is further inserted beyond the state shown in FIG. 4, and the sheet cassette 3 has moved to the insertion position I. As shown in FIG. 5, the pin member 32 moves upward along the curved shape of the end portion 21*e* of the guide groove 21*h*. The lever 23 abuts against the abutting portion 22*c*, and the rotation thereof is restricted. The tip 25*t* of the auxiliary lever 25 abuts against an inner surface on the back side of the cover 22, and the rotation of the auxiliary lever 25 is restricted.

When the sheet cassette 3 is pulled out from the main body 15, the above-described movements are performed in the reverse order, and the sheet cassette 3 moves in the withdrawing direction while receiving the force in the insertion direction by the first side wall 23*f* via the pin member 32. The pin member 32 moves in the pull-out direction along the guide groove 21*h*. The lever 23 pivots toward the pulling-out direction side, and engages with the locking portion 22*l* of the cover 22 by the hook 23*h* of the pin engagement portion 23*t*, and the engagement between the pin member 32 and the pin engagement portion 23*t* is released.

As described above, when the sheet cassette 3 is inserted, the engagement between the hook 23*h* of the pin engagement portion 23*t* and the locking portion 22*l* of the cover 22 is released. The pin member 32 connected to the sheet cassette 3 engages with the pin engagement portion 23*t* of the lever 23. The elastic member 24 pushes the lever 23 to rotate toward the far side. As a result, the lever 23, which is biased to rotate toward the back side, exerts a force toward the pin member 32 in the back side direction, and the sheet cassette 3 is drawn into the insertion position I through the pin member 32.

Next, an operation for when the sheet cassette 3 and the sheet cassette lead-in mechanism 20 are engaged again after the sheet cassette 3 and the sheet cassette lead-in mechanism 20 are not properly engaged with each other will be described.

Figure 6:
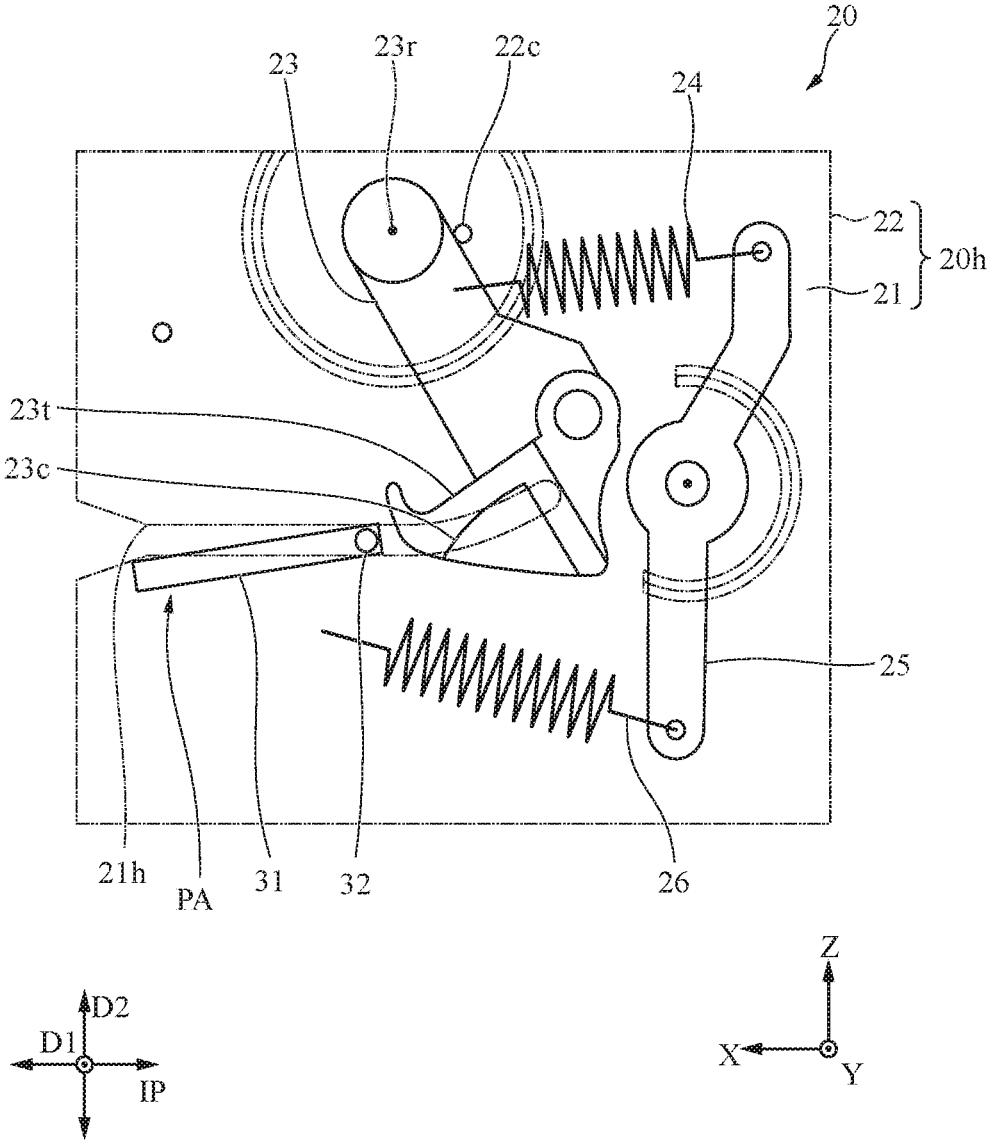
FIG. 6 is a side view illustrating a case where a sheet cassette lead-in mechanism is not properly engaged.

FIG. 6 is a diagram illustrating a case where the insertion end PA of the sheet processing apparatus 1 and the sheet cassette lead-in mechanism 20 are not properly engaged with each other. FIG. 6 illustrates a case where the engagement between the hook 23*h* of the pin engagement portion 23*t* and the locking portion 22*l* of the cover 22 has been released for some reason before the paper sheet cassette 3 is properly inserted and the pin member 32 is brought into contact with the pin engagement portion 23*t*.

As illustrated in FIG. 6, when the engagement between the hook 23*h* and the locking portion 22*l* is released, the lever 23 is rotated to the insertion direction side by the pulling force of the elastic member 24 without engaging the pin member 32. In this case, during the insertion operation of the sheet cassette 3, the pin member 32 moves in the insertion direction along the guide groove 21*h* without receiving a force in the insertion direction. At this time, the contact surface 23*c* and the guide groove 21*h* are arranged so that the leading end of the contact surface 23*c* overlaps the guide groove 21*h* in the side view, and the contact surface 23*c* intersects the guide groove 21*h* at an acute angle.

Figure 7:
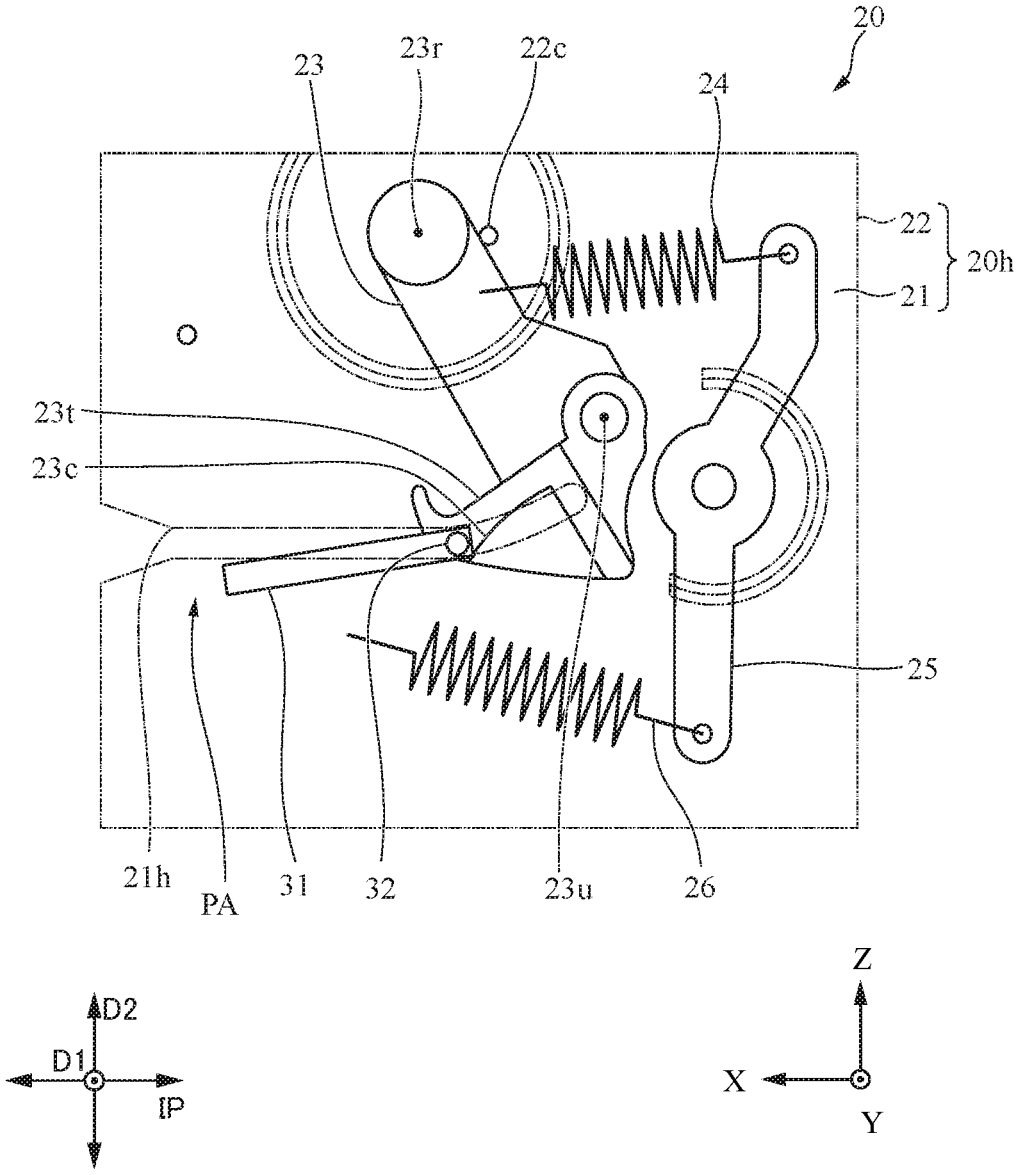
FIG. 7 is a side view illustrating a case where the drawing end of a sheet processing apparatus is engaged with a sheet cassette lead-in mechanism.

FIG. 7 illustrates a state in which the sheet cassette 3 is moved further in the insertion direction beyond the state illustrated in FIG. 6. As shown in FIG. 7, when the contact surface 23*c* of the pin engagement portion 23*t* intersects the guide groove 21*h* in a side view, when the paper sheet cassette 3 is moved in the inserting direction, the pin member 32 abuts against the contact surface 23*c* of the pin engagement portion 23*t*.

Figure 8:
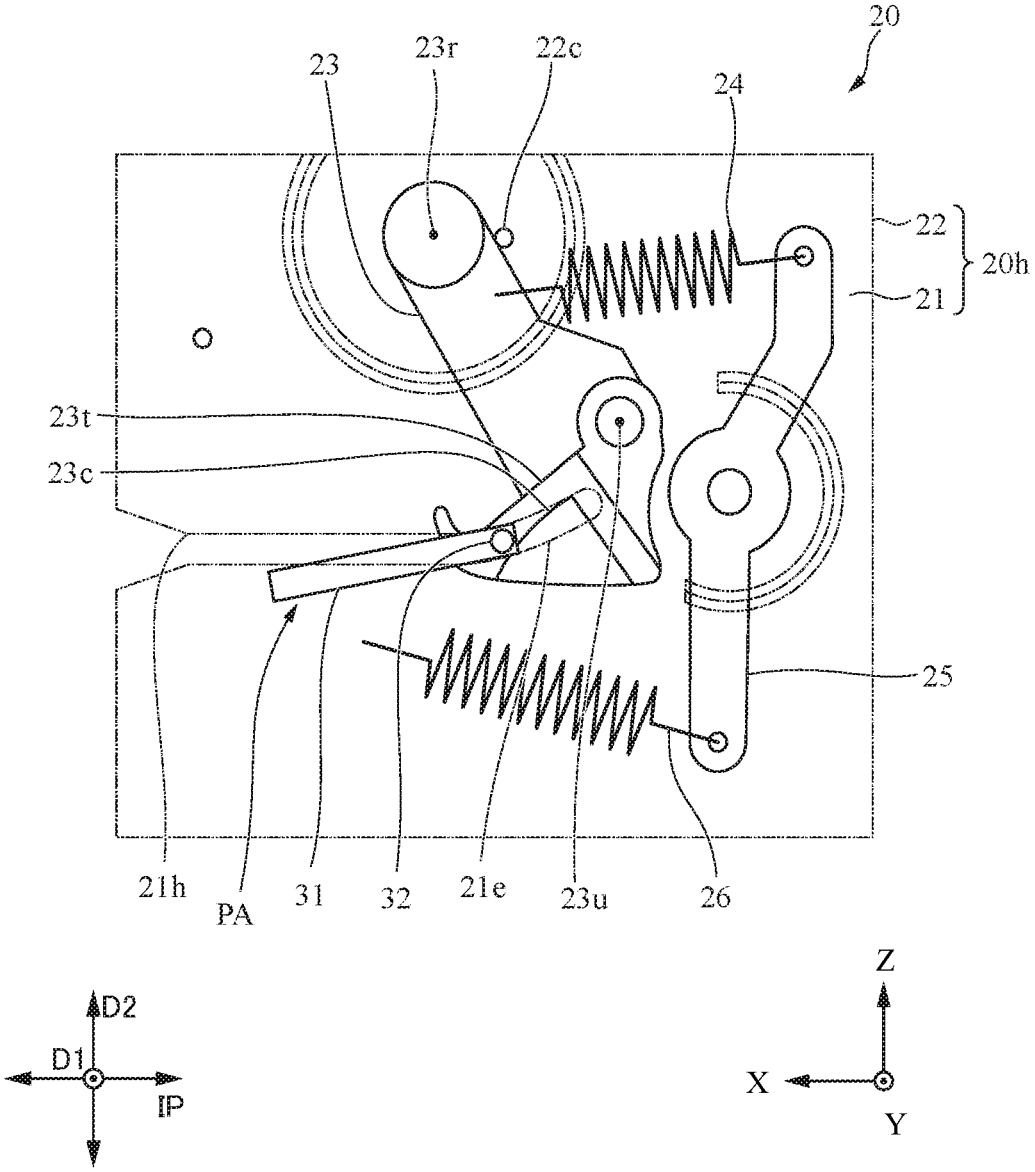
FIG. 8 is a side view illustrating a case where the drawing end of a sheet processing apparatus is engaged with a sheet cassette lead-in mechanism.

FIG. 8 illustrates a state in which the sheet cassette 3 is further moved in the insertion direction beyond the state illustrated in FIG. 7. As shown in FIG. 8, when the sheet cassette 3 is further moved in the insertion direction, the pin member 32 moves along the curved shape of the end portion 21*e* of the guide groove 21*h*, and presses the pin engagement portion 23*t* through the contact surface 23*c*. The pin engagement portion 23*t* pushed by the pin member 32 rotates downward around the sub-rotation shaft 23*u* due to the contact surface 23*c* intersecting the guide groove 21*h* at an acute angle in a side view.

Figure 9:
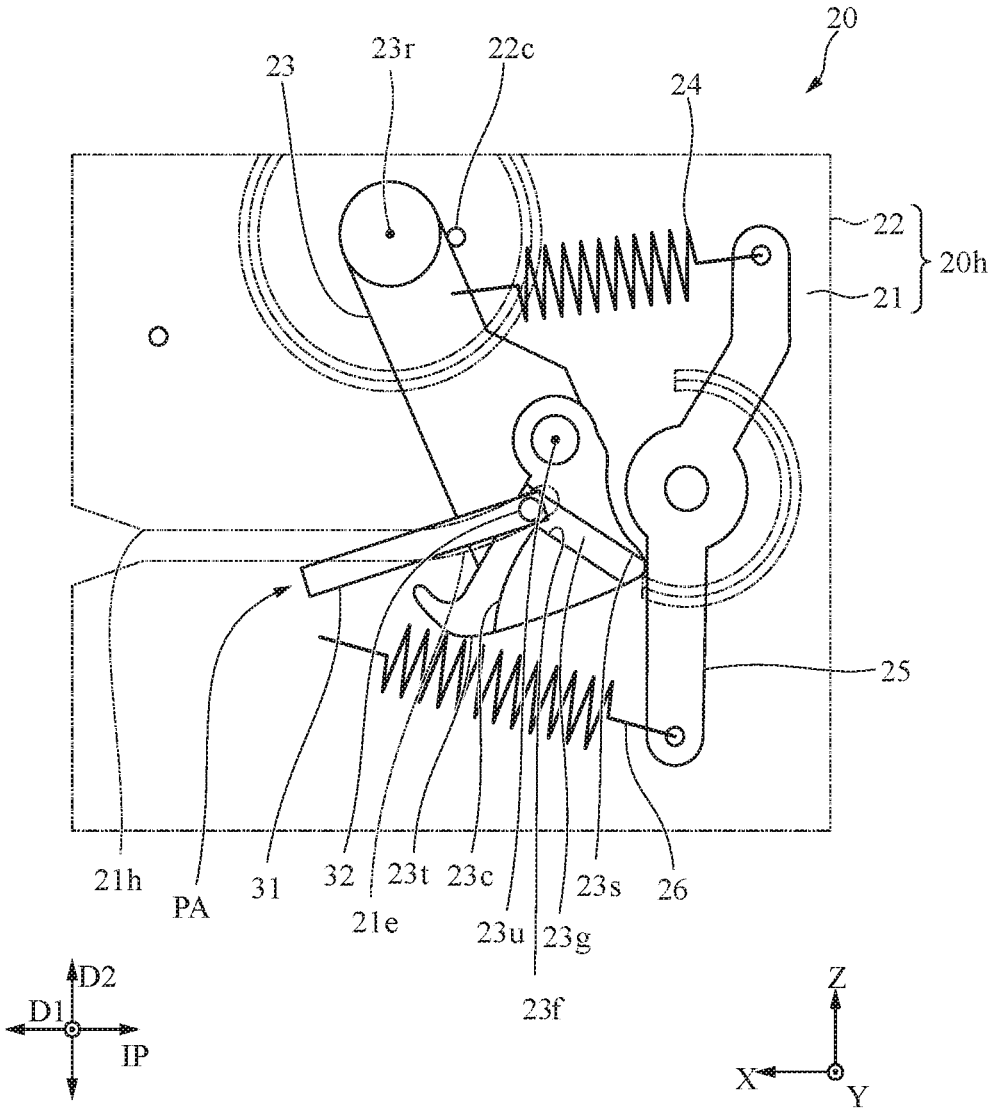
FIG. 9 is a side view illustrating a case where the drawing end of a sheet processing apparatus is engaged with a sheet cassette lead-in mechanism.

FIG. 9 illustrates a state in which the sheet cassette 3 is further moved in the insertion direction beyond the state illustrated in FIG. 8. As shown in FIG. 9, when the sheet cassette 3 is further moved in the insertion direction, the pin member 32 is disposed in the engagement groove 23*g* while being moved relative to the pin engagement portion 23*t* along the contact surface 23*c*.

When the sheet cassette 3 is further moved in the insertion direction beyond the state illustrated in FIG. 9, the pin member contacts the second side wall 23*s* and causes the pin engagement portion 23*t* to rotate about the sub-rotation shaft 23*u*. The rotated pin engagement portion 23*t* is in the state shown in FIG. 5, and the first side wall 23*f* is disposed on the front side of the pin member 32.

According to the sheet processing apparatus 1 of the present embodiment, when only the lever 23 of the sheet cassette lead-in mechanism 20 moves toward the insertion direction side without engaging the pin member 32 due to any cause, the pin member 32 rotates the pin engagement portion 23*t* and is disposed in the engagement groove 23*g* just by the inserting of the sheet cassette 3 in a normal manner. Therefore, when the sheet feed cassette 3 and the sheet cassette lead-in mechanism 20 were not properly disengaged from each other, the user can return to a state in which the sheet feed cassette 3 can be inserted and the sheet feed cassette 3 and the sheet cassette lead-in mechanism 20 are appropriately engaged.

The end portion 21*e* of the guide groove 21*h* is curved upward, so that the pin member 32 easily rotates the pin engagement portion 23*t*, and the pin member 32 is easily disposed in the engagement groove 23*g*.

The contact surface 23*c* is curved in a convex shape in a direction away from the first side wall 23*f*, so that the force of pushing the sheet cassette 3 required for pushing and rotating the pin engagement portion 23*t* by the pin member 32 is reduced.

Since the movable angle on the front side of the lever 23 is larger than the movable angle on the far side, the force required for withdrawing the sheet cassette 3 from the insertion position I outward is reduced.

By having the sliding rib 21*l*, the lever 23 and the auxiliary lever 25 are prevented from wobbling in the swinging motion. When the sliding rib 21*l* has the oil groove 21*o*, the friction force with respect to the pivoting motion of the lever 23 and the auxiliary lever 25 is reduced.

When the distance between the first side wall 23*f* and the second side wall 23*s* is equal to or less than 1.2 times the diameter of the cross-section perpendicular to the axial dimension 32*o* of the pin member 32, the impact and the sound generated when the pin member 32 pushes the second side wall 23*s* and releases the engagement between the hook 23*h* and the locking portion 22*l* and abuts against the first side wall 23*f* are reduced.

Since the main rotation shaft 23*r* of the lever 23 and the rotation shaft 25*r* of the auxiliary lever 25 are held by the chassis 21 and the cover 22, the rotation of the main rotation shaft 23*r* and the rotation shaft 25*r* in the rotation direction is suppressed from being disturbed.

The chassis 21 and the cover 22 are connected to each other, and the chassis 21 or the cover 22 is integrally formed with the locking portion 22*l*, the abutting portion 22*c*, the sliding rib 21*l*, and the like, and thus it is easy to manufacture the sheet cassette lead-in mechanism 20 in an inexpensive and uniform quality.

In some examples, sheet processing apparatus 1 does not require the auxiliary lever 25 and the auxiliary elastic member 26, as long as there is a space for ensuring the extension of the elastic member 24 required to generate an appropriate tensile force. When the auxiliary lever 25 and the auxiliary elastic member 26 are not provided, the proximal end 24*p* of the elastic member 24 can be directly connected to the chassis 21 or the cover 22.

In the example sheet processing apparatus 1, the insertion-extraction direction is the depth direction, the first direction is the left-right direction, and the second direction is the up-down direction. In other examples, sheet processing apparatus 1 may be configured such that the first direction is the up-down direction and the second direction is the left-right direction in the horizontal direction. The sheet processing apparatus 1 may be configured such that the insertion-extraction direction is the left-right direction, and the first direction is the depth direction. The sheet processing apparatus 1 may be configured such that the insertion-extraction direction is the left-right direction, the first direction is the up-down direction, and the second direction is the depth direction.

The sheet processing apparatus 1 of some variations need only be parallel to the first direction or the second direction, and need not be orthogonal to the first direction and the second direction.

The sliding rib 21*l* may be formed in the cover directly. The locking portion 22*l* or the abutting portion 22*c* may be formed in the chassis 21. A temporary fixing hole or the like used to assemble the chassis or cover may be formed in the chassis or the cover.

According to at least one embodiment described above, when the sheet cassette 3 and the sheet cassette lead-in mechanism 20 are not properly engaged with each other, the user can still easily engage the sheet cassette 3 and the sheet cassette lead-in mechanism 20 with each other.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A sheet processing apparatus, comprising:

a main body including an insertion slot;

a sheet cassette configured to be inserted into the main body via the insertion slot and removed from the main body via the insertion slot, the sheet cassette including a pin member extending in a first direction orthogonal to an insertion direction of the sheet cassette, the pin member being connected to the sheet cassette so as to be moveable in a second direction orthogonal to the first direction and the insertion direction; and a housing in the main body and including:

a lever partially rotatable about a first axis proximate to a first end of the lever, the first axis being parallel to the first direction, the lever having a pin engagement portion at a tip portion at a second end of the lever opposite the first end, the pin engagement portion being rotatable about a second axis parallel to the first direction and having an engagement groove into which the pin member can be inserted from a first pin engagement position and a second pin engagement position when the lever has rotated about the first axis;

an elastic member configured to apply a force to the lever to rotate the lever toward the insertion direction, the elastic member being connected to the lever at a position between the first axis and the pin engagement portion; and a chassis having a guide groove formed therein, the guide groove extending along the insertion direction and controlling the position of the pin member in the second direction, the guide groove including an inclining portion that is inclined with respect to the insertion direction and is farther along the insertion direction than an intake portion of the guide groove for receiving the pin member into the guide groove.

2. The sheet processing apparatus according to claim 1, wherein the first axis is fixed to housing.

3. The sheet processing apparatus according to claim 1, wherein the housing includes a sliding rib formed on an inner surface thereof, and the lever moves along the sliding rib when rotated about the first axis.

4. The sheet processing apparatus according to claim 3, further comprising:

an oil groove on the inner surface of the housing and adjacent to the sliding rib.

5. The sheet processing apparatus according to claim 3, wherein the sliding rib is arc-shaped.

6. The sheet processing apparatus according to claim 1, wherein the pin engagement portion includes a hook portion spaced from the second axis and adjacent to the second pin engagement position of the engagement groove, and the housing includes a hook engagement portion with which the hook portion can engage when the sheet cassette is withdrawn from the insertion slot.

7. The sheet processing apparatus according to claim 1, wherein the housing further includes therein:

an auxiliary lever configured to rotate about a third axis parallel to the first direction, a first end of the auxiliary lever being connected to an end of the elastic member, and a second end of the auxiliary lever being connected to another elastic member having an end connected to the housing.

8. The sheet processing apparatus according to claim 1, wherein the elastic member is a spring.

9. The sheet processing apparatus according to claim 1, wherein the pin member is on a first end of a link member and a second end of the link member opposite the first end of the link member is connected to the sheet cassette by a rotatable connection.

10. The sheet processing apparatus according to claim 1, wherein the engagement groove is continuous from the first engagement position to the second engagement position.

11. The sheet processing apparatus according to claim 1, wherein the engagement groove has a first sidewall that extends from the first engagement position to the second engagement position and a second sidewall nearer the second axis than is the first sidewall, and the second sidewall is substantially parallel to a direction connecting the first and second ends of the lever.

12. The sheet processing apparatus according to claim 11, wherein the first sidewall includes a first portion extending in a direction substantially parallel to the second sidewall and a second portion extending in a direction intersecting the direction substantially parallel to the second sidewall.

13. A printer, comprising:

a main body including an insertion slot;

an image forming unit in the main body and configured to form images on sheets of paper;

a sheet cassette for supplying sheets of paper to the image forming unit and configured to be inserted into the main body via the insertion slot and removed from the main body via the insertion slot, the sheet cassette including a pin member extending in a first direction orthogonal to an insertion direction of the sheet cassette, the pin member being connected to the sheet cassette so as to be moveable in a second direction orthogonal to the first direction and the insertion direction; and a housing in the main body and including:

a lever partially rotatable about a first axis proximate to a first end of the lever, the first axis being parallel to the first direction, the lever having a pin engagement portion at a tip portion at a second end of the lever opposite the first end, the pin engagement portion being rotatable about a second axis parallel to the first direction and having an engagement groove into which the pin member can be inserted from a first pin engagement position and a second pin engagement position when the lever has rotated about the first axis;

an elastic member configured to apply a force to the lever to rotate the lever toward the insertion direction, the elastic member being connected to the lever at a position between the first axis and the pin engagement portion; and a chassis having a guide groove formed therein, the guide groove extending along the insertion direction and controlling the position of the pin member in the second direction, the guide groove including an inclining portion that is inclined with respect to the insertion direction and is farther along the insertion direction than an intake portion of the guide groove for receiving the pin member into the guide groove.

14. The printer according to claim 13, wherein the housing includes a sliding rib formed on an inner surface thereof, the lever moves along the sliding rib when rotated about the first axis, and the sliding rib is arc-shaped.

15. The printer according to claim 14, further comprising:

an oil groove on the inner surface of the housing and adjacent to the sliding rib.

16. The printer according to claim 13, wherein the pin engagement portion includes a hook portion spaced from the second axis and adjacent to the second pin engagement position of the engagement groove, and the housing includes a hook engagement portion with which the hook portion can engage when the sheet cassette is withdrawn from the insertion slot.

17. The printer according to claim 13, wherein the housing further includes therein:

an auxiliary lever configured to rotate about a third axis parallel to the first direction, a first end of the auxiliary lever being connected to an end of the elastic member, and a second end of the auxiliary lever being connected to another elastic member having an end connected to the housing.

18. The printer according to claim 13, wherein the engagement groove is continuous from the first engagement position to the second engagement position.

19. The printer according to claim 13, wherein the engagement groove has a first sidewall that extends from the first engagement position to the second engagement position and a second sidewall nearer the second axis than is the first sidewall, and the second sidewall is substantially parallel to a direction connecting the first and second ends of the lever.

20. The printer according to claim 19, wherein the first sidewall includes a first portion extending in a direction substantially parallel to the second sidewall and a second portion extending in a direction intersecting the direction substantially parallel to the second sidewall.

* * * * *